US005232214A

United States Patent [19]

Matsuura et al.

[11] Patent Number: 5,232,214

[45] Date of Patent: Aug. 3, 1993

[54] PAPER SUPPLYING APPARATUS AND METHOD USING A DETACHABLE CASSETTE

[75] Inventors: Yasuhiro Matsuura, Osaka; Tetsuya Ouchi, Toyokawa, both of Japan

[73] Assignee: Minolta Camera Kabushiki Kaisha, Osaka, Japan

[21] Appl. No.: 794,684

[22] Filed: Nov. 19, 1991

Related U.S. Application Data

[63] Continuation of Ser. No. 489,526, Mar. 7, 1990, abandoned.

[30] Foreign Application Priority Data

Mar. 8, 1989 [JP] Japan ..... 1-55385

[51] Int. Cl.[5] ..... B65H 1/08

[52] U.S. Cl. ..... 271/127; 271/121; 271/160; 271/162

[58] Field of Search ..... 271/121, 126, 127, 160, 271/162, 164, 117

[56] References Cited

U.S. PATENT DOCUMENTS

| | | | |
|---|---|---|---|
| 3,689,064 | 9/1972 | Kuksa | 271/164 |
| 4,280,692 | 7/1981 | Hutchinson et al. . | |
| 4,595,191 | 6/1986 | Uchiyama et al. . | |
| 4,740,817 | 4/1988 | Suzuki et al. | 271/164 X |
| 4,799,662 | 1/1989 | Sagara et al. | 271/164 X |
| 4,915,370 | 4/1990 | Himeji et al. | 271/162 |
| 4,998,714 | 3/1991 | Sparer et al. | 271/164 X |
| 5,002,266 | 3/1991 | Kikuchi et al. | 271/9 X |

FOREIGN PATENT DOCUMENTS

| | | | |
|---|---|---|---|
| 172128 | 7/1989 | Japan | 271/164 |

*Primary Examiner*—Robert P. Olszewski
*Assistant Examiner*—Boris Milef
*Attorney, Agent, or Firm*—Burns, Doane, Swecker & Mathis

[57] ABSTRACT

This invention discloses a paper supplying device for supplying paper sheets to an image forming portion of an image forming apparatus, which include a cassette attachable to the body of the image forming apparatus for storing the paper sheets therein, an accommodating portion provided at the body of the image forming apparatus for accommodating the cassette thereinto, paper supplying member disposed at an upper portion in said accommodating portion for supplying the paper sheets in the cassette in a direction opposed to a cassette insertion direction toward the image forming portion, and guiding member provided in the accommodating portion for guiding the cassette in a first position through a second position toward a third position, the cassette being completely inserted into the accommodating portion in said first position and an uppermost surface of the paper sheets in the cassette being pressed into contact with the paper supplying member in the third position.

15 Claims, 9 Drawing Sheets

PAPER SUPPLYING APPARATUS AND METHOD USING A DETACHABLE CASSETTE

This application is a continuation of application Ser. No. 07/489,526, filed Mar. 7, 1990 now abandoned.

BACKGROUND OF THE INVENTION

1. Field of the Invention

The present invention relates to a paper supplying apparatus that supplies paper for an image forming apparatus in a copy machine, printer, facsimile machine or the like, and more specifically relates to a cassette-type paper supplying apparatus.

2. Description of the Related Art

In recent years progress has been made in reducing the scale of image forming apparatus used in copy machines, printers and facsimile machines. For the purpose of reducing the size of the main device, a paper supplying apparatus has been proposed having a configuration wherein a paper supplying cassette is completely accommodated within a paper supplying portion provided in the main device, as shown in FIG. 1.

Image forming apparatus 120, shown in FIG. 1, is provided a paper supplying portion 123 within image forming apparatus main unit 122 (hereinafter referred to as "main unit"). Paper supplying cassette 121 is installable within paper supplying portion 123 in the direction of arrow [A]. The uppermost surface of the paper accommodated in paper cassette 121 which is installed in paper supplying portion 123 is pressed against paper supplying roller 125. Further, a separating hook 126 is provided in paper cassette 121 to separate. only the paper sheet in the uppermost position from the remaining plurality of sheets to be transported by paper supplying roller 125. Sheets transported by paper supplying roller 125 and separated by separating hook 126 are inverted in inverting portion 124, then transported to the image forming portion in main unit 122.

A disadvantage of the previously mentioned sheet separation by the aforesaid separating hook 126 is that said separation is uncertain and cannot cope with conditions in high-speed image forming methods.

The paper supplying apparatus of the aforesaid construction presents a further disadvantage in that when paper cassette 121 is extracted in the opposite direction to arrow [A] to allow removal of a paper jam in inverting portion 124, the jammed sheet may be pulled along with paper cassette 121 as said cassette 121 is extracted in the opposite direction to arrow [A] thereby tearing a portion of said jammed sheet and causing said torn portion of the jammed sheet to remain in main unit 122.

SUMMARY OF THE INVENTION

A main object of the present invention is to provide a paper supplying apparatus capable of accurately supplying paper to the image forming portion of the main unit of an image forming apparatus.

A further object of the present invention is to provide a paper supplying apparatus which does not allow a part of a jammed sheet to be torn by the operation of extracting the paper cassette from the paper supplying portion after a paper jam occurs in the paper supplying portion of the main unit of the image forming apparatus.

A still further object of the present invention is to provide a paper supplying apparatus wherein a paper jam in the main unit of the image forming apparatus can be removed in conjunction with the paper cassette removal operation.

These and other objects of the present invention are accomplished by providing a paper supplying apparatus comprising a paper supplying cassette that accommodates the paper to be supplied and is removable from the main unit of the image forming apparatus;

a receiving portion provided within the main unit of the image forming apparatus, said receiving portion having an insertion port for accommodating the aforesaid paper supplying cassette therein;

a paper supplying means disposed above the receiving portion for transporting the paper accommodated within the paper cassette in the opposite direction to the cassette insertion direction so as to supply paper to the image forming portion;

a guide means provided in the guide portion for guiding a paper supplying cassette, which is disposed at a first position after said cassette is inserted in the receiving portion via the insertion port, through a second position to reach a third position where the uppermost sheet of paper accommodated in the cassette is pressed against the aforesaid paper supplying means, the aforesaid second position being located downstream from the aforesaid first and third positions in the cassette insertion direction.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following drawings, like parts are designated by like reference numbers throughout the several drawings.

DETAILED DESCRIPTION OF THE PREFERRED EMBODIMENTS

The first embodiment of the paper supplying apparatus of the present invention is hereinafter described with reference to the accompanying drawings.

Figure 1:
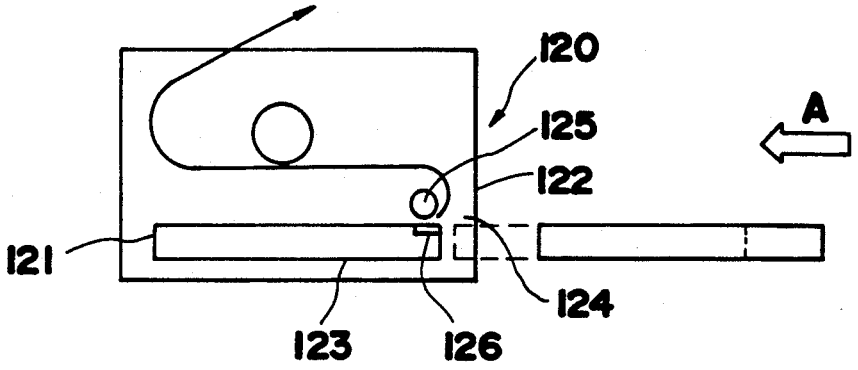
FIG. 1 Prior Art
FIG. 1 is a brief illustration showing the construction of a conventional paper supplying apparatus.
Figure 2:
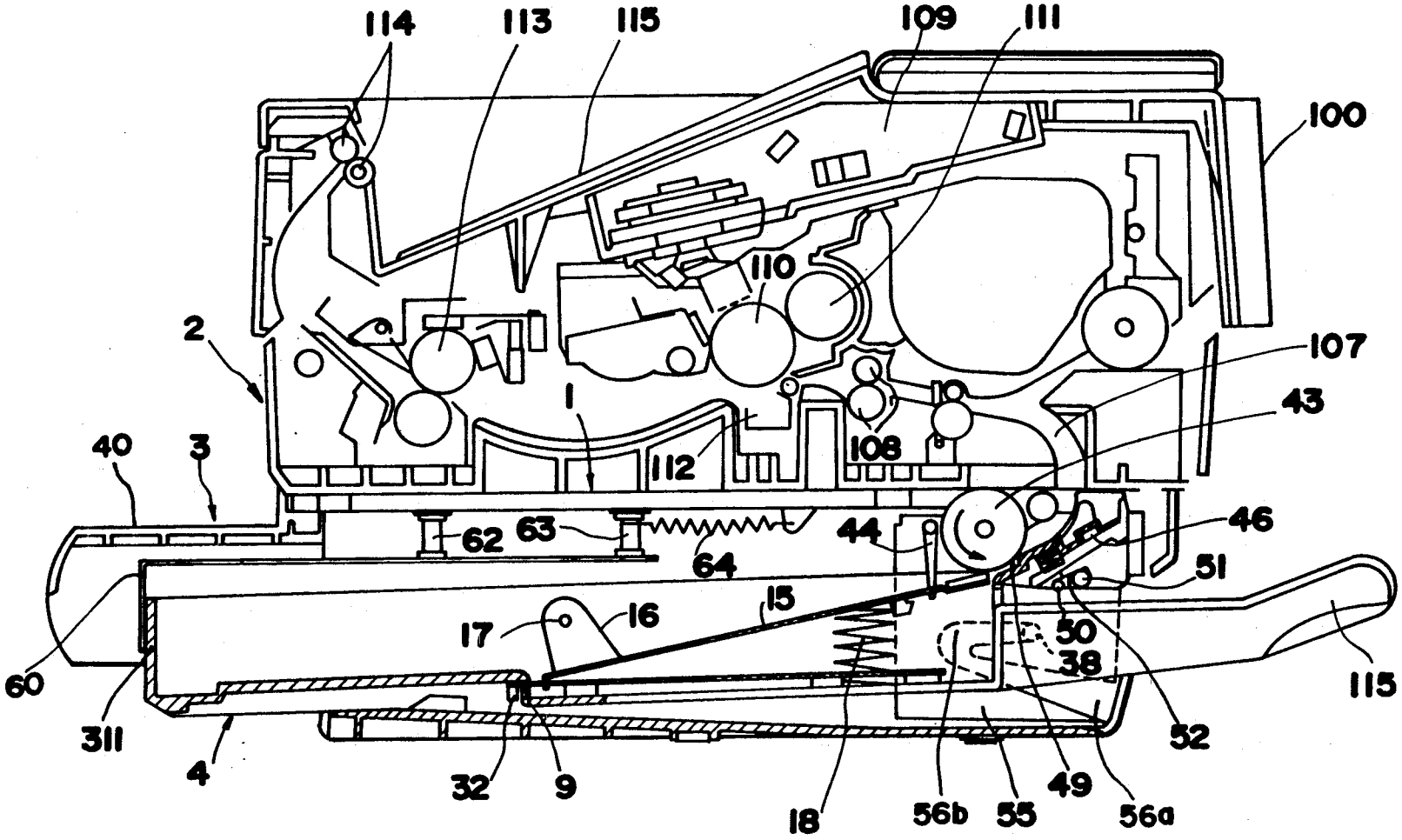
FIG. 2 is a cross section view of an image forming apparatus employing a first embodiment of the paper supplying apparatus of the present invention.

FIG. 2 is a brief section view of an image forming apparatus provided with the first embodiment of the paper supplying apparatus of the present invention. Paper cassette 4 is provided so as to be removable from the main unit of image forming apparatus 2 from the operating panel 100 side. The paper supplied to the main unit of image forming apparatus 2 is stacked on riser plate 15 provided in paper cassette 4, and the uppermost sheet is pressed against paper supplying roller 43 via a coil compression spring 18. Paper supplying roller 43 is rotated counterclockwise by a drive device not shown in the drawings, so that the paper is transported to the leading edge of friction pad 49. Friction pad 49 is formed from urethane rubber or the like, and makes pressure contact with paper supplying roller 43 due to a uniform force applied thereto by coil compression spring 18.

The paper which has been transported to the leading edge of friction pad 49 is advanced one sheet at a time by said friction pad 49, passes through curved transport path 107, and is transported to timing roller 108. Next, an electrostatic latent image is formed on the surface of a photoconductive member 110 by exposure device 109, and thereafter said latent image is developed into a developed (visible) image by developing device 111. Subsequently, after the leading edge of the paper sheet is aligned with the leading edge of the developed image formed on the surface of photoconductive member 110, said sheet is transported to transfer device 112. The developed image on the surface of photoconductive member 110 is then transferred to the sheet by transfer device 112, and the sheet is thereafter transported to fixing device 113. The developed image on the sheet is fixed thereto by fixing device 113, and the discharge roller 114 then discharges the sheet onto discharge tray 115.

The first embodiment of the paper supplying apparatus of the present invention is described hereinafter with reference to FIGS. 3 through 9.

Paper Supplying Apparatus

Paper supplying apparatus 1 comprises a paper supplying portion 3 provided at the bottom of image forming apparatus main unit 2 in a copy machine or the like, and a paper supplying cassette 4 removably installed in the aforesaid paper supplying apparatus 3.

Paper Cassette

Figure 3:
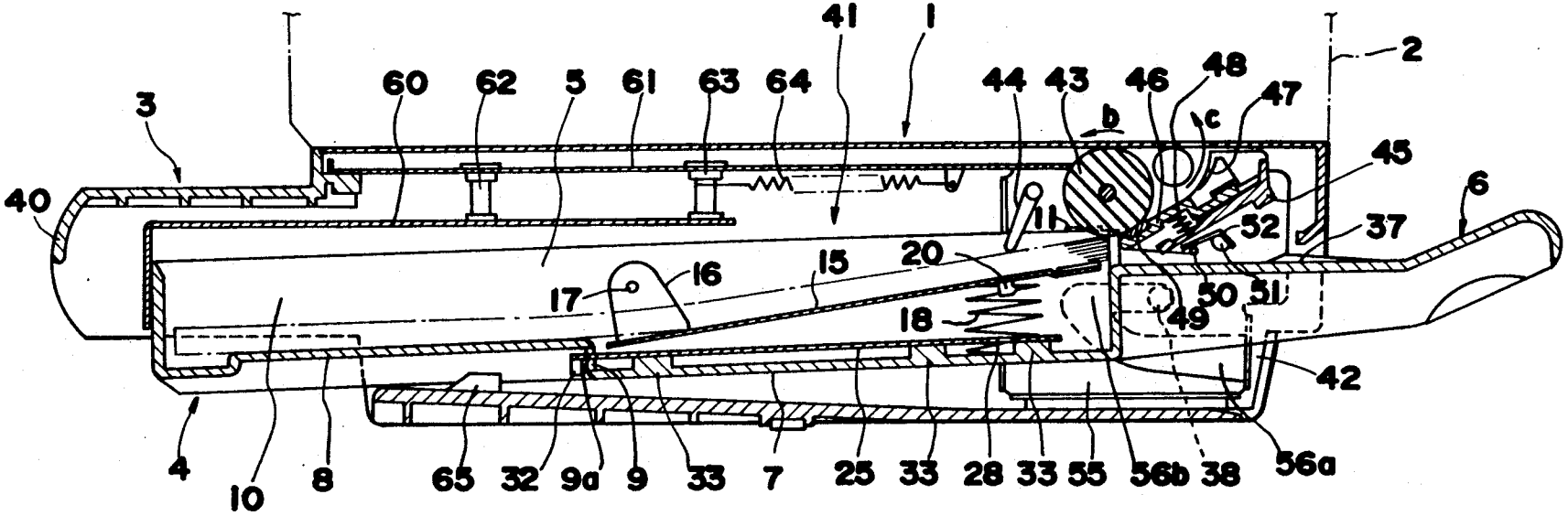
FIG. 3 is a cross section view of the first embodiment of the paper supplying apparatus.

Paper cassette 4 has a handle 6 extending from side wall 10 of the enclosed paper accommodating portion 5 which is open at the top, as shown in FIG. 3.

A first bottom plate 7 (right side in the drawing) and a second bottom plate 8 (left side in the drawing) are provided within paper accommodating portion 5. A through-hole 9*a* is provided in a bottom vertical wall 9 positioned between first and second bottom plates 7 and 8, and a lock plate 25 described later is inserted in through-hole 9*a*. Stoppers 11 are provided at opposite sides at one end of handle 6 at side walls 10 of paper accommodating portion 5. Wall 12, to which handle 6 of paper accommodating portion 5 is attached, is disposed lower than side wall 10 so as to form a paper supply opening 13. A concavity 14 is provided in the center of paper supply opening 13 so as to be one level lower. (See FIG. 4.)

Figure 5:
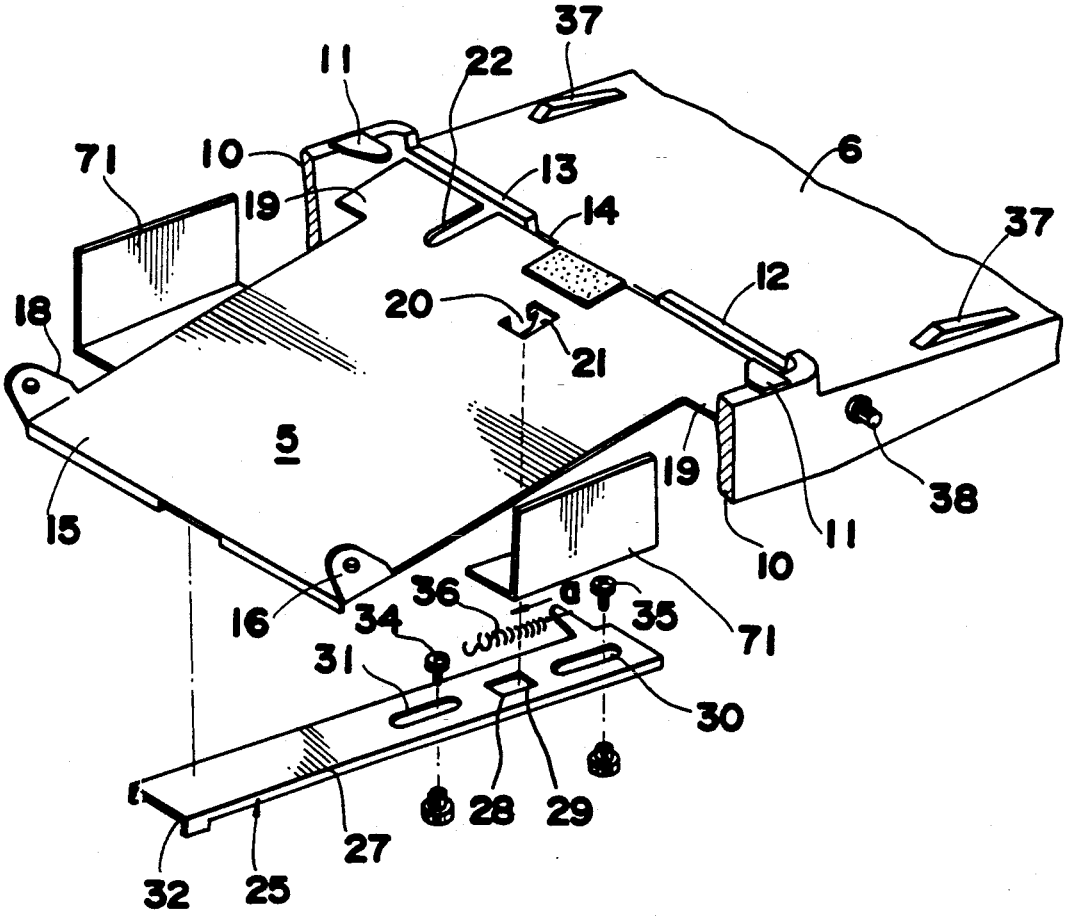
FIG. 5 is a perspective view of the paper supplying cassette.

Riser plate 15 is rotatably supported by side walls 10 of paper accommodating portion 5 via shafts 17 and flanges 16 provided at either side at one end of said riser plate 15, so as to allow the other end of said riser plate 15 to move vertically along the wall 12 of paper accommodating portion 5. Riser plate 15 is forced upwardly by spring 18 provided therebelow. Further, as shown in FIG. 5, riser plate 15 contacts with stoppers 11 at contacting portions 19. A downwardly curved hook 20 is provided at one part of riser plate 15 between contacting portions 19, and a slit 22 is disposed between said hook 20 and one contacting portion 19 on one side.

As shown in FIG. 5, downwardly bent flanges 27 ar provided at both sides of lock plate 25 in the lengthwise direction. Lock plate 25 is provided with a locking hole 28 and guide holes 30 and 31. Protrusions 32 are provided at one end of each flange 27. Lock plate 25 is disposed below riser plate 15 on a plurality of supports 33 provided on the first bottom plate 7 of paper accommodating portion 5. Lock plate 25 is screwed to the aforesaid supports 33 by bolts 34 and 35 inserted in guide holes 30 and 31, so as to be movable in the arrow [a] direction via the force applied by spring 36.

Paper regulating plates 71 confront one another in position next to side walls 10 so as to control the paper in the width direction.

The top of handle 6 is provided protrusions 37 which extend along side walls 10.(See FIG. 3.) Guide pins 38 are disposed opposite each other at said handle 6. In addition, handle 6 is configured so as to have a specified inclination in the paper cassette 4 withdrawal direction.

Paper Supplying Portion

As shown in FIG. 3, a receiving portion 41 is provided within compartment 40 of paper supplying portion 3 to accommodate paper cassette 4. And an insertion port 42 is provided at the left side of receiving portion 41 in the drawing.

Paper supplying roller 43 is disposed above and proximate to insertion port 42 of receiving portion 41 and makes contact with the uppermost sheet in paper cassette 4. A paper-empty detecting plate 44 is rotatably provided upstream from the contact position of paper roller 43 and the uppermost sheet in the direction of roller rotation. A holder 45 is fixedly attached to roller 43 downstream from the contact position of paper roller 43 and the uppermost sheet in the direction of roller rotation, said holder 45 supporting a holder 46 having a paper guide 47 in such a way that said holder 46 is swingingly movable. Holder 46 is forced upward by a spring 48, and a friction pad 49 attached to leading edge thereof makes pressure contact with the exterior surface of paper supplying roller 43. A pin 50 attached to holder 46 is connected to lever 52 which is fixedly attached to rotatably supported shaft 51. Cams 53 are fixedly mounted to the aforesaid shaft 51 (refer to FIG. 9).

Returning now to FIG. 2, side frames 55 are disposed adjacent to insertion port 42 of receiving portion 41. Side frames 55 are each provided with a U-turn channel 56. U-turn channels 56 have entrances at the bottom of insertion port 42, and comprise a sloping portion 56*a* facing forward from said entrance, and a U-turn portion 56*b* extending therefrom in a U-shaped configuration so as to face the top of insertion port 42.

L-shaped pressure plate 60 is disposed in front of receiving portion 41 and is supported by pins 62 and 63 on guide plate 61 attached to the cover of receiving portion 41 so as to be movable in the cassette insertion direction. A spring force in the cassette withdrawal direction by is applied to pressure plate 60 by spring 64, the ends of which are attached to guide plate 61 and pin 63.

Paper Cassette Accommodation

Figure 4:
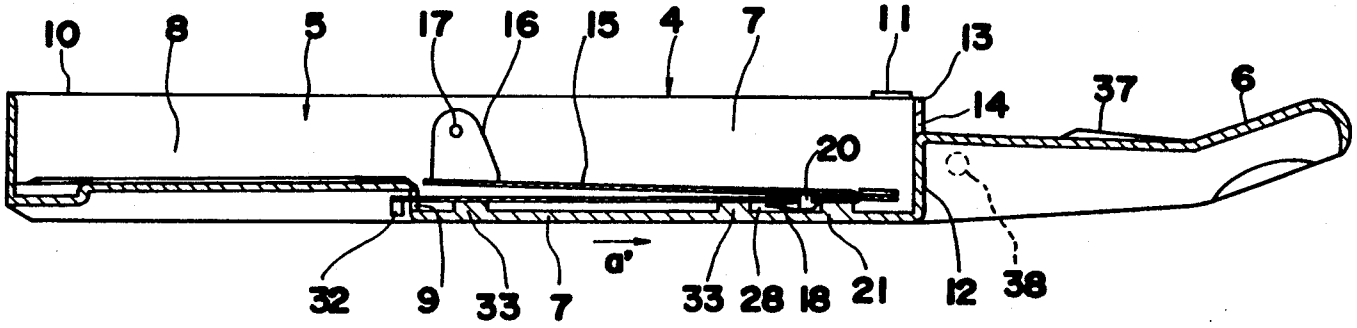
FIG. 4 is a section view of the paper supplying cassette.

When paper is accommodated in cassette 4, the riser plate 15, which is pressed upwardly by spring 18 as shown in FIG. 3, is pushed downward against the force of spring 18, as shown in FIG. 4.

At this time, sloping portion 21 (refer to FIG. 5) of hook 20 on riser plate 15 moves downwardly as it oscillates with one end 29 of lock hole 28 of lock plate 25. Lock plate 25 moves in the opposite direction to that indicated by arrow [a] against the force applied by spring 36. Further, when riser plate 15 is depressed to a specified position, hook 20 engages with lock hole 28 to lock said riser plate 15 to lock plate 25.

Thus, paper is accommodated in the paper accommodating portion 5 in the previously described state. When paper is accommodated, riser plate 15 readily accommodates the paper without hindrance because said riser plate 15 is fixedly attached to lock plate 25 of paper accommodating portion 5.

Paper Cassette Removal

Paper-filled cassette 4 is inserted in and removed from paper supplying portion 3 in the following manner.

Figure 6:
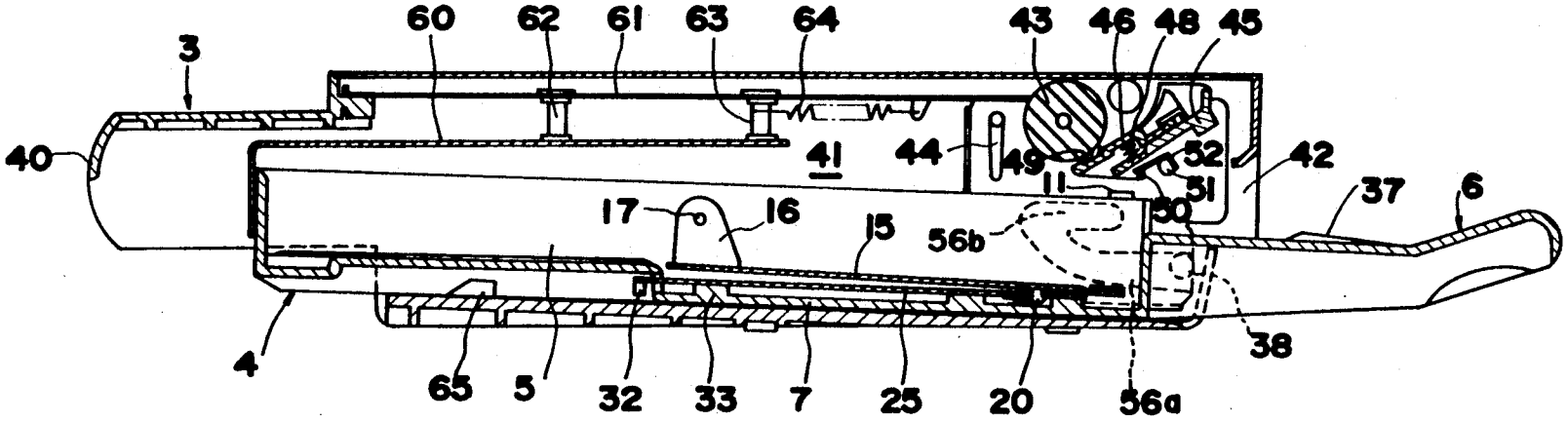
FIGS. 6, 7 and 8 are section views showing the paper supplying cassette being inserted into the receiving portion to the point of complete installation.

As shown in FIG. 6, paper-filled cassette 4 is inserted into receiving portion 41 via insertion port 42. When handle 6 is inserted into insertion port 42, pins 38 disposed on both sides of said handle 6 are guided to U-turn channels 56 formed on side frames 55 of receiving portion 41. At the same time, a front wall 311 of paper accommodating portion 5 makes contact with L-shaped pressure plate 60.

Figure 7:
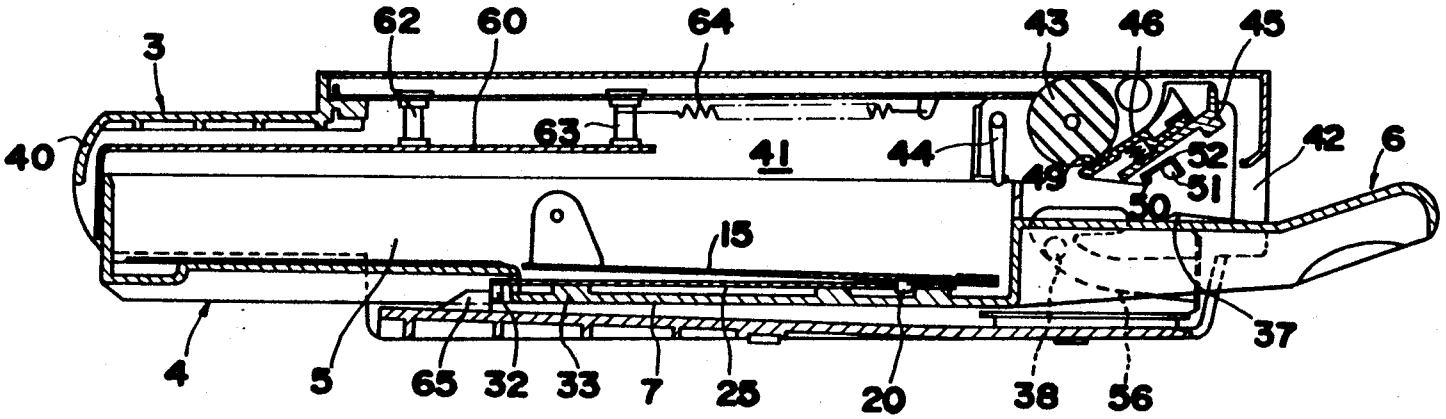

Between the state shown in FIG. 6 and that shown in FIG. 7, paper cassette 4 is forced against the spring force of spring 64, and when guide pins 38 are inserted into and pass through the sloping portion 56*a* of U-turn channels 56 and reach U-turn portions 56*b*, the protrusions 32 on lock plate 25 protrude below the bottom of paper accommodating portion 5 and make contact with stoppers 65 provided on the bottom surface of receiving portion 41. At the same time, paper cassette 4 is moved upwardly guided by sloping portion 56*a*.

Figure 8:
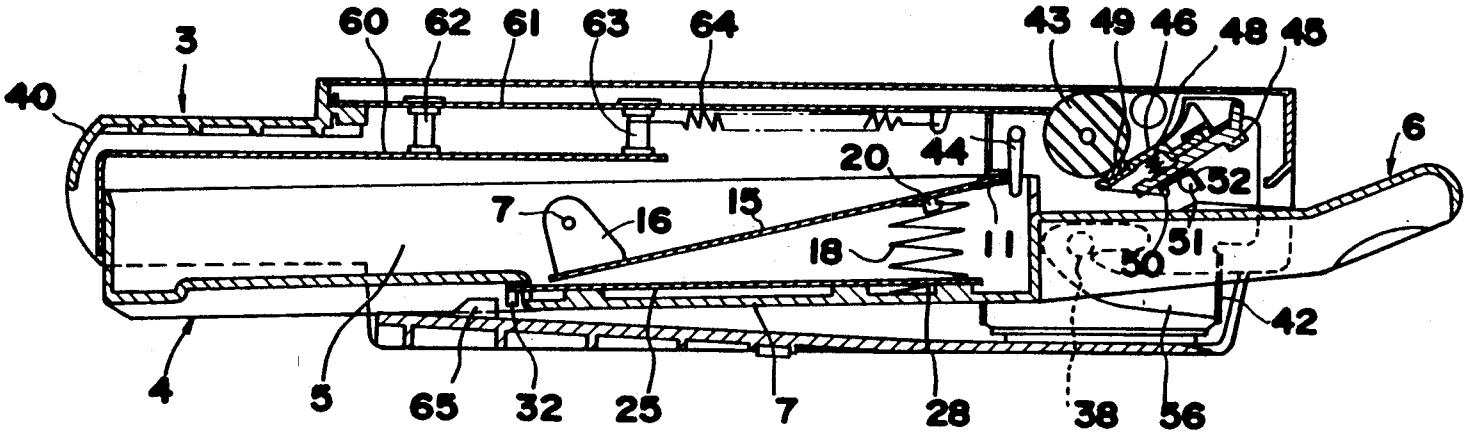

When paper cassette 4 is pushed so as to advance guide pins 38 to the position of U-turn portion 56*b* of U-turn channel 56, said paper cassette 4 advances toward insertion port 42 in synchronization with the advance of said guide pins 38, as shown in FIG. 8. This situation results in protrusion 32 of lock plate 25, which is in contact with stopper 65, moving toward insertion port 42, and hook 20 of riser plate 15 disengages from lock hole 28 of lock plate 25. Therefore, riser plate 15 is pushed upwardly via the force applied by spring 18, and both ends of the paper on riser plate 15 make contact with stoppers 11.

Next, when paper cassette 4 stops being forced, in the state described in FIG. 8, cassette 4 is pushed back toward insertion port 42 by the force of spring 64 acting on pressure plate 60, and the uppermost sheet of paper makes pressure contact with the exterior surface of paper supplying roller 43, as shown in FIG. 3. At this time, paper supplying roller 43 is positioned at concavity 14 provided on wall 12 of paper accommodating portion 5.

When paper supplying roller 43 rotates while in the previously described state, the sheet is transported toward insertion port 42 through paper supply entrance 13 of accommodating portion 5 via the rotation of paper supplying roller 43, as shown in FIG. 3. Then, the sheet is guided by paper guides 47 and supplied to main unit 2 of the copy machine in the direction of arrow [c].

Additional sheets are prevented from being transported from accommodating portion 5 together with the aforesaid uppermost sheet by means of friction pad 49 due to the friction produced between the pad and the uppermost sheet being transported to main unit 2.

When all the sheets have been taken from paper cassette 4, paper-empty detecting plate 44 intrudes into slit 22 of riser plate 15, and the paper-empty state is detected by detecting the aforesaid movement with a sensor.

Figure 9:
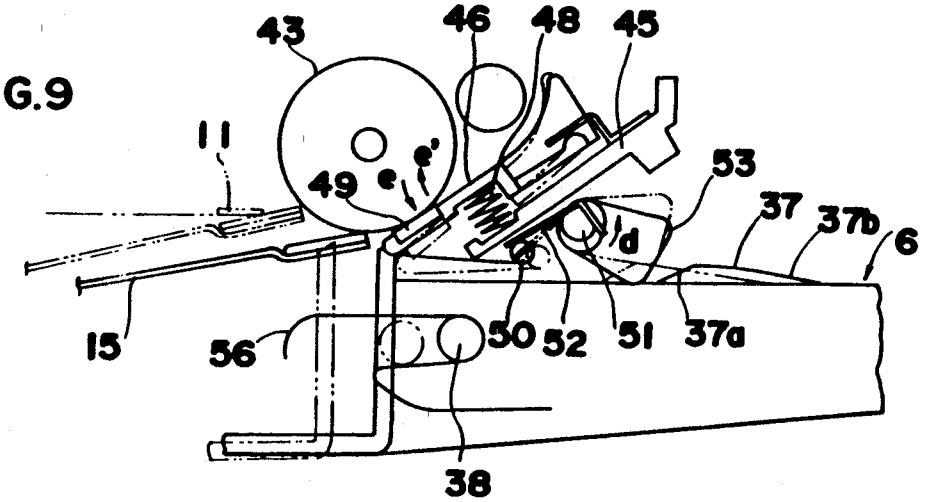
FIG. 9 is a cross section view showing the operating state of the paper cassette when said cassette is withdrawn from the receiving portion.

When paper cassette 4 is removed, said cassette 4 is forced against the force of spring 64 from the position described by the solid line to the position described by the broken line in FIG. 9. Then, cams 53 oscillate to first oscillation position 37*a* of protrusions 37 on handle 6, and rotate in the arrow [d] direction. At the same time, shaft 51 and lever 52 are rotated in the same direction by the rotation of cam 53. Lever 52 presses pin 50, holder 46 rotates in the arrow [e] direction, and friction pad 49 moves to position indicated by the broken line and retracts from the paper supplying roller 43.

The result of the aforesaid sequence is that the sheet grasped between the friction pad 49 and paper supplying roller 43 is stopped with the leading edge portion transported downstream thereof, releasing the jammed sheet.

On the other hand, when the leading edge of riser plate 15 withdraws from paper supplying roller 43, the sheet and jammed sheet make pressure contact with stoppers 11 and are grasped between riser plate 15 and stoppers 11 on two sides due to the force applied by said riser plate 15.

When cassette 4 is pushed until pins 38 of cassette 4 reach the sloping portion 56*a* of U-turn channel 56, cams 53 oscillate to second oscillation position 37*b* of protrusions 37, and return to the position indicated by the solid line in the drawing. Holder 46 rotates in the arrow [e'] direction due to the force applied by spring 48, and friction pad 49 again makes pressure contact with paper supplying roller 43.

Subsequently, when the force on cassette 4 is weakened, said cassette 4 falls by its own weight as guide pins 38 enter sloping portion 56*a*. Then, cassette 4 is forced toward insertion port 4 by spring 64 of pressure plate 60, so as to be forced back to the entrance to be withdrawn from insertion port 42. At this time, the sheet and jammed sheet grasped between stoppers 11 and riser 15 as previously described are removed together with cassette 4. Accordingly, jammed sheets can be removed without damage in the paper supplying apparatus of the present invention.

A second embodiment of the paper supplying apparatus is described hereinafter.

In the second embodiment, a nonreturn mechanism 200 is provided to U-turn channel 56 for guiding cassette 4 through pins 38. Since the construction of the second embodiment is identical to that of the first embodiment except for nonreturn mechanism 200, the description of the second embodiment is abbreviated here.

When paper cassette 4 in the second embodiment is installed in or removed from paper supplying portion 3 of the main unit of the image forming apparatus, cassette 4 guide pins 38 are guided by U-turn portion 56*b* of U-turn channel 56 so as to install said cassette 4 at a specified installed position.

The previously mentioned nonreturn mechanism 200 prevents cassette 4 guide pins 38 from returning from the U-turn portion 56*b* to sloping portion 56*a* due to the weight of said cassette 4.

The operation of the nonreturn mechanism 200 during the installation and removal procedures of cassette 4 in paper supplying portion 3 is hereinafter described with reference to FIGS. 10 through 15.

First, nonreturn mechanism 200 is explained with reference to FIG. 10. Nonreturn mechanism 200 comprises a guide 201 and lock lever 204. Guide 201 is oscillatingly connected to side frame 55 of receiving portion 41 via a first oscillating shaft 202. Guide 201 is provided first, second and third projections 201*a*, 201*b* and 201*c* which extend in the removal direction for cassette 4. The second projection 201*b* is positioned at the boundary of U-turn portion 56*b* and sloping portion 56*a* of U-turn channel 56. Second projection 201*b* of guide 201 projects into U-turn channel 56 so a to prevent guide pins 38 of cassette 4 in the sloping portion 56*a* from entering U-turn portion 56*b*. Because first oscillating shaft 202 is linked to one end of side frame 55 by spring 203, first oscillating shaft 202 and guide 201 are forced in the arrow [f] direction by said spring 203. The bottom of lock lever 204 has a hook 204*a*, flat portion 204*b*, and sloping portion 204*c* protruding into U-turn channel 56. The lock lever 204 is provided above the guide 201, resulting in that the flat portion 204*b* makes pressure contact with the projection 201*c*. Lock lever 204 is oscillatably connected to side frame 55 within receiving portion 41 via second oscillating shaft 205. On the other hand, side frame 55 is provided a curved portion 55*a* to stop the oscillating tip 204*d* of lock lever 204, and a projection 55*b* connected to spring 206, the other end of which is connected to said oscillating tip 204*d*, as shown on the left side of FIG. 10. Lock lever 204 is forced in the arrow [g] direction by spring 206.

The operation of nonreturn mechanism 200 when cassette 4 is installed in receiving portion 41 is hereinafter described with reference to FIGS. 10 to 13.

Figure 10:
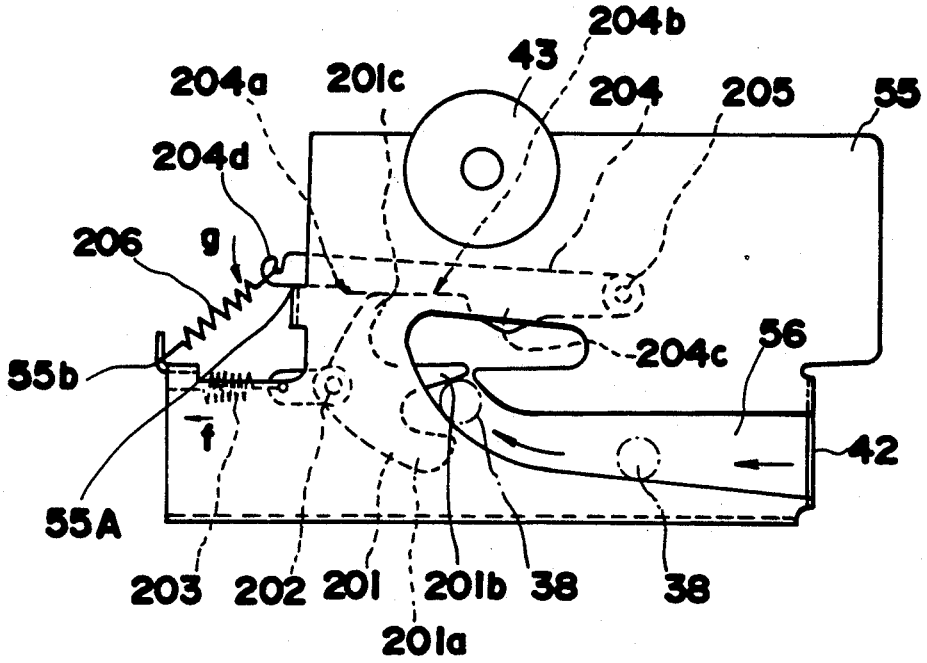
FIGS. 10 to 13 are illustrations showing the operating state when a paper supplying cassette having a nonreturn mechanism is installed in a second embodiment of the paper supplying apparatus of the present invention.
Figure 11:
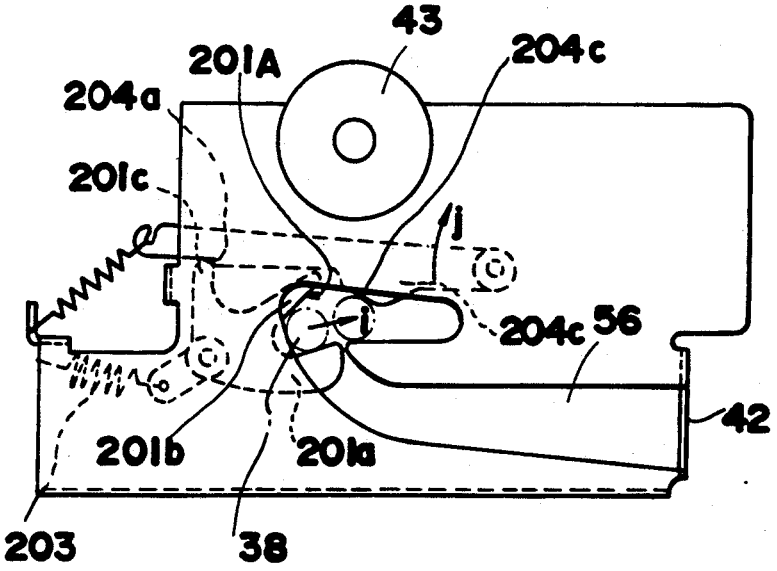
Figure 12:
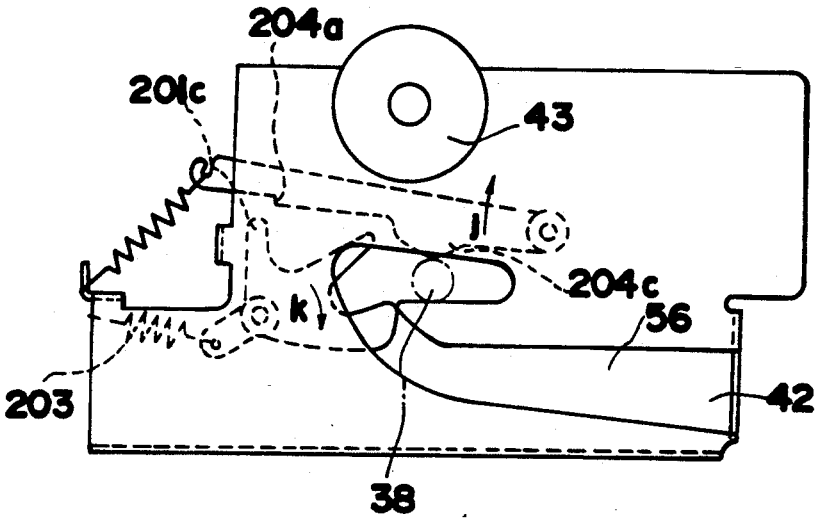
Figure 13:
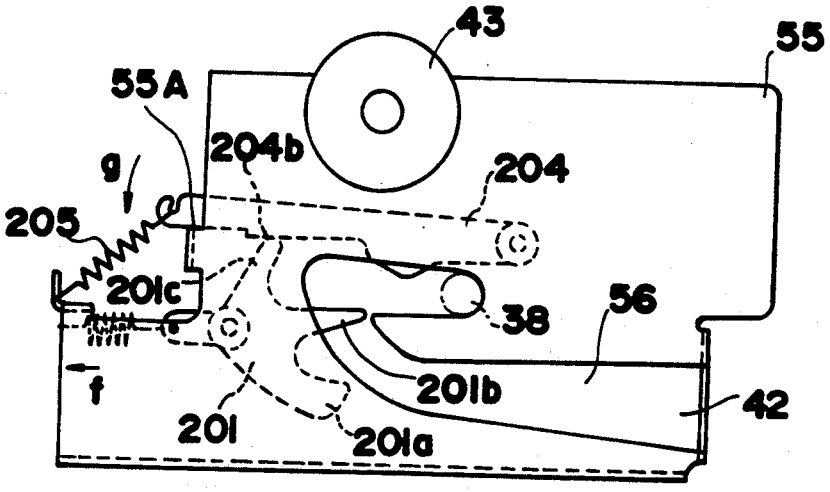

When cassette 4 is inserted in insertion portion 42, cassette 4 guide pins 38 are guided into sloping portion 56*a* of U-turn channel 56, and make contact with second projection 201*b* of guide 201, as shown in FIG. 10. When paper cassette 4 is further inserted in insertion portion 42, the second projection 201*b* is pressed upwardly by guide pin 38 in U-turn portion 56*b* and the tip of third projection 201*c* engages with hook 204*a* of lock lever 204, as shown in FIG. 11. Because at this time guide pins 38 are supported on first projection 201*a* of guide 201, said guide pins 38 in U-turn portion 56*b* are prevented from again returning to sloping portion 56*a* due to the weight of cassette 4. When the insertion of cassette 4 is stopped, guide pins 38 supported on first projection 201*a* in U-turn portion 56*b* are moved in the arrow [i] direction by the force applied by spring 64 (refer to FIG. 3). Guide pins 38 moving in the arrow [i] direction make contact with sloping portion 204*c* of lock lever 204 that intrudes into U-turn portion 56*b* and advance in the arrow [i] direction. Lock lever 204 is therefore pushed in the arrow [j] direction by guide pins 38, and third projection 201*c* and hook 204*a* of lock lever 204 disengage, as shown in FIG. 12, whereupon guide 201 oscillates to a specified position before cassette 4 insertion, as shown in FIG. 13. On the other hand, lock lever 204, which has disengaged from guide 201, is oscillated in the arrow [g] direction by the force applied by spring 206, to a specified position prior to cassette 4 insertion as well as guide 201.

The operation of nonreturn mechanism 200 when cassette 4 is withdrawn from receiving portion 41 is hereinafter described with reference to FIGS. 14 and 15.

Figure 14:
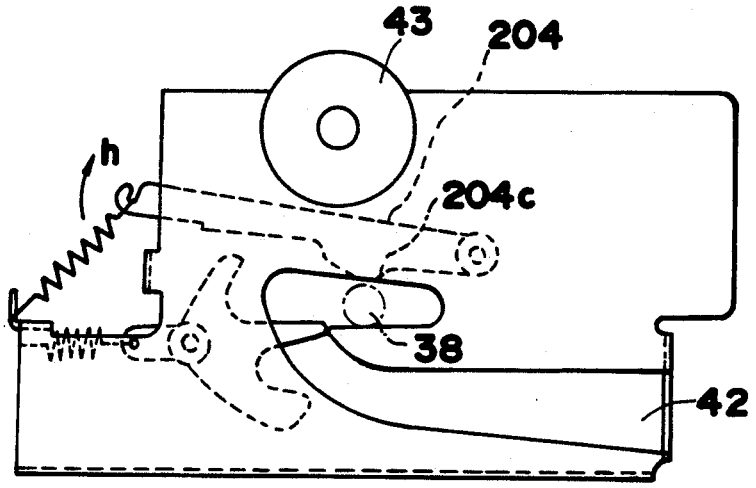
FIGS. 14 and 15 show the operating state of the nonreturn mechanism when the paper cassette is withdrawn from the receiving portion.

When handle 6 of cassette 4 is pushed, cassette 4 guide pins 38 oscillate to the position shown in FIG. 14, and make contact with sloping portion 204*c* of lock lever 204 which intrudes into U-turn portion 56*b* When handle 6 is further pushed, guide pins 38, which are in contact with sloping portion 204*c*, push lock lever 204 in the arrow [h] direction. Thus, lock lever 204 separates from guide 201. Then, guide pins 38, which oscillate in U-turn portion 56*b* are supported on second projection 201*b* of guide 201 which extends to the boundary of sloping portion 56*a* and U-tarn portion 56*b* in U-turn channel 56. At this time, cassette 4 is forced in the arrow [1] by spring 64, and at the same time guide pins 38 cause guides 201 to rotate in the arrow [n] direction, as shown in FIG. 15, due to the load in the arrow [m] direction from the weight of cassette 4, and enter sloping portion 56*a*. When guide pins 38 are in sloping portion 56*a*, they advance in the arrow [1] direction until cassette 4 reaches the insertion port 42, whereupon cassette 4 can be removed from said insertion port 42.

Figure 15:
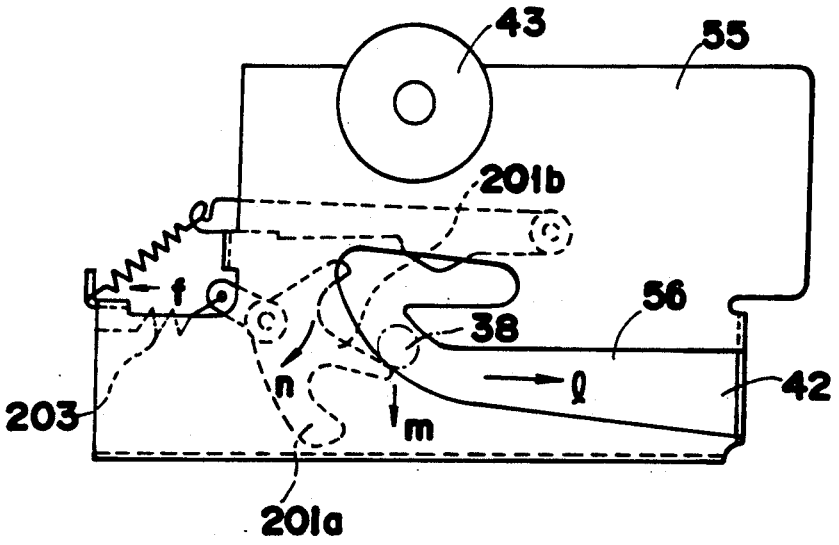

After cassette 4 is removed, guide 201 is forced in the arrow [f] direction by spring 203, so that it returns from the position shown in FIG. 15 to the specified position in FIG. 14.

The relational forces among springs 64, 203 and 206 are as follows: the force of spring 64 is greater than the force of spring 206 which is greater than or equal to the force of spring 203.

In the paper supplying apparatus of the present invention as previously described, paper cassette 4 does not make contact with peripheral sensors because said cassette 4 is vertically movable when pushed to a certain degree.

Although the paper jams were removed in connection with the withdrawal operation for cassette 4 in the aforesaid embodiment, jams may also be removed from the rear portions of the image forming apparatus main unit or paper supplying apparatus.

Further, although paper handling examples were explained according to friction pad 49 making contact with the bottom peripheral surface of paper supply roller 43 in the aforesaid embodiment, other paper supplying methods may be used wherein, in substitution for said friction pad 49, a paper handling roller that rotates in the opposite direction to supplying roller 43 is used in conjunction with roller 43 so as to make pressure contact with the bottom peripheral surface of said roller 43, or other paper supply method may be used.

Further, stoppers 11 need not be arranged on side wall 10, but instead may be provided at the leading edge of paper regulating plate 71 extending in the paper supply direction.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A paper supplying device for supplying paper sheets to an image forming portion of an image forming apparatus, which comprises:

a cassette attachable to a body of the image forming apparatus for storing the paper sheets therein;

an accommodating portion provided at the body of the image forming apparatus for accommodating said cassette thereinto;

paper supplying means disposed at an upper portion in said accommodating portion for supplying the paper sheets in the cassette in a direction opposed to a cassette insertion direction toward the image forming portion; and guiding means provided in the accommodating portion for guiding the cassette from a first position wherein an uppermost surface of the paper sheets in the cassette are in pressing contact with said paper supplying means to a second position wherein the paper supplying means is not in contact with the uppermost surface, said second position being located at the downstream side of the first position with respect to the cassette insertion direction upon the detachment of the cassette from the first position.

2. A paper supplying device as claimed in claim 1 further comprising:

separating means disposed at the upper portion in the accommodating portion for preventing the paper sheets other than the uppermost paper sheet in the cassette from being supplied by the paper supplying means.

3. A paper supplying device as claimed in claim 2 wherein said separating means is retractable from the paper supplying means.

4. A paper supplying device as claimed in claim 1 wherein the cassette inserted into the accommodating portion is moved to the first position through the second position to be attached to the accommodating portion by use of the guiding means.

5. A paper supplying device as claimed in claim 3 wherein separating means is retracted from the paper supplying means in response to movement from the first position to the second position of the cassette.

6. A paper supplying device as claimed in claim 1 wherein the cassette includes walls for regulating the width of the paper sheets in the cassette, a supporting member for supporting the paper sheets thereover and first urging means for upwardly urging the supporting member, the walls being provided with stoppers which are in pressing contact with the uppermost paper sheet in the cassette so that the paper supplied out of the cassette by the paper supplying means are grasped between the supporting member and the stoppers when the cassette in the first position is moved to the second position.

7. A paper supplying device as claimed in claim 1 wherein the cassette has a lever which is provided with a pair of guide pins and the guiding means includes guide grooves for respectively guiding said guide pins.

8. A paper supplying device as claimed in claim 1 wherein an urging means is disposed in the accommodating portion for urging the cassette in a cassette detachment direction.

9. A paper supplying device as claimed in claim 1 wherein the guiding means is provided with nonreturn means for certainly guiding the cassette from the second position to the first position.

10. In a paper supplying device for supplying paper sheets to an image forming portion in an image forming apparatus comprising a cassette in the body of the image forming apparatus for storing the paper sheets to be supplied, an accommodating portion provided at the body of the image forming apparatus and having an insertion port for accommodating the cassette inserted through said insertion port, and paper supplying means disposed at an upper portion in the accommodating portion for supplying the paper sheets in the cassette in a direction opposed to a cassette insertion direction toward the image forming portion, a method comprising the steps of:

guiding the cassette in a first position to a second position, an uppermost surface of the paper sheets in the cassette being in pressing contact with the supplying means in the first position and said second position being located at an upstream side of the first position with respect to the paper supply direction; and detaching the cassette in the second position by guiding the cassette in the paper supply direction from the accommodating portion through the insertion port.

11. A paper supplying device for supplying paper sheets to an image forming portion of an image forming apparatus, which comprises:

a cassette attachable to a body of the image forming apparatus for storing the paper sheets therein; and paper supplying portion provided in the image forming apparatus and including means for supplying the paper sheets from the cassette which is inserted in the paper supplying portion, and means for guiding the cassette in a direction opposite a paper supply direction from a paper feeding position to an intermediate position in the paper supplying portion, and means for guiding the cassette in a paper supply direction from the intermediate position out of the paper supplying portion.

12. A paper supplying device as claimed in claim 11, further comprising:

a guide member provided at the paper supplying portion for downwardly guiding the cassette after guiding the cassette in the direction opposed to the paper supply direction.

13. A method for detaching a paper accommodating cassette from a paper supplying portion of an image forming apparatus, said method comprising the steps of:

first moving in a direction opposed to a paper supplying direction the cassette inserted in the paper supplying portion of the image forming apparatus upon the detachment of the cassette;

second moving in the paper supplying direction the cassette inserted in the paper supplying portion of the image forming apparatus; and detaching the cassette from the paper supplying portion of the image forming apparatus.

14. A paper supplying device for supplying paper sheets to an image forming apparatus, which comprises:

a cassette attachable to a body of the image forming apparatus for storing the paper sheets therein;

an accommodating portion provided at the body of the image forming apparatus for accommodating said cassette therein;

paper supplying means disposed at an upper portion in said accommodating portion for supplying the paper sheets in the cassette in a direction opposed to a cassette insertion direction toward the image forming portion when the cassette is in a paper position wherein the uppermost sheet in the cassette is in pressing contact with said paper supplying means;

means for guiding the cassette in the cassette insertion direction from the paper supply position to a detached position; and guiding means provided in the accommodating portion for downwardly guiding the cassette from the detached position.

15. A paper supplying device for supplying a paper sheet to an image-forming portion in an image-forming apparatus, which comprises:

a cassette for storing a stack of paper sheets attachable to a body of the image forming apparatus;

an accommodating portion provided at the body of the image-forming apparatus for accommodating said cassette therein;

paper supplying means disposed at an upper portion in said accommodating portion for supplying the paper sheets in the cassette in a direction opposite to the cassette insertion direction toward the image-forming portion;

guiding means provided in the accommodating portion for guiding the cassette during detachment from a paper feeding position to a second position, said second position located at a downstream side of the paper feeding position with respect to the cassette insertion direction, a leading end of an uppermost paper sheet of the sheet stack with respect to the sheet supply direction being positioned to confront with the paper supplying means when said cassette is in the paper feeding position.

* * * * *